US005234186A

United States Patent [19]

Powell

[11] Patent Number: 5,234,186

[45] Date of Patent: Aug. 10, 1993

[54] WRIST REST FOR KEYBOARD

[76] Inventor: Richard G. Powell, 4615 Lake Forest Dr., NW., Atlanta, Ga. 30342

[21] Appl. No.: 951,659

[22] Filed: Sep. 25, 1992

[51] Int. Cl.[5] ..... B43L 15/00

[52] U.S. Cl. ..... 248/118.1; 248/918; 400/715

[58] Field of Search ..... 248/118, 118.1, 118.3, 248/118.5, 918, 346; 400/715; 132/73

[56] References Cited

U.S. PATENT DOCUMENTS

| | | | |
|---|---|---|---|
| 105,001 | 7/1870 | Sanborn | 248/118.5 |
| 3,300,250 | 1/1967 | Dollgener et al. | 248/118 X |
| 4,482,063 | 11/1984 | Berke et al. | 248/118 X |
| 5,074,511 | 12/1991 | Wilson | 248/918 X |
| 5,108,057 | 4/1992 | Dandy, III et al. | 248/118 |
| 5,125,606 | 6/1992 | Cassano et al. | 248/118 |
| 5,131,614 | 7/1992 | Garcia et al. | 248/918 X |
| 5,163,646 | 11/1992 | Engelhardt | 400/715 X |
| 5,183,230 | 2/1993 | Walker et al. | 248/118.3 X |

OTHER PUBLICATIONS

CTS Wrist Rest product flyer, Reynolds Computer Supplies, Inc., Roswell, GA 30075.

*Primary Examiner*—Karen J. Chotkowski
*Attorney, Agent, or Firm*—Jones & Askew

[57] ABSTRACT

An improved wrist rest for use when typing on a typical computer keyboard for reducing the severity of symptoms of hand and wrist repetitive stress ailments such as carpal tunnel syndrome is disclosed. The apparatus includes a rectilinear keyboard support base to which a wrist supporting rail is secured. Cross sections perpendicular to the axis of elongation of the rail have a geometry that includes forward and rearward nodes with a palm depression lying therebetween for supporting the hypothenars of the user's hands. A plane tangential to both forward and rearward nodes of the support rail intersects the plane of the keyboard support surface at a predetermined angle that is equal to the angle of the keyboard's key plane with respect to the horizontal when same is placed on a horizontal work surface.

24 Claims, 3 Drawing Sheets

WRIST REST FOR KEYBOARD

TECHNICAL FIELD

The present invention relates to the field of apparatus for prevention of injuries in the office work place, and in particular is an improved wrist support for use with computer and other keyboards that alleviates the symptoms of hand and wrist repetitive motion stress ailments including carpal tunnel syndrome in workers who type at such keyboards for extended periods of time.

BACKGROUND OF THE INVENTION

While typewriters have been widely used in offices for the majority of the twentieth century, the greatest proliferation of typing keyboards has occurred in the last 15 years since relatively powerful, inexpensive, general purpose computers become readily available in the marketplace. An explosive growth in the use of computers and their normally associated keyboards has taken place in most of the modern industrialized world.

Additionally, computers have tended to become smaller and most feature relatively lightweight keyboards that are physically detached from their associated computers, being connected only by a cable for carrying electrical representations of the keystrokes. This has led to the use of keyboards in many different physical settings, including the laps of users and on desk tops of varying heights from the floor.

The widespread proliferation of keyboards is believed to have contributed to a significant increase in the incidence of a repetitive motion stress syndrome known as carpal tunnel syndrome. Carpal tunnel syndrome is a serious condition that can lead to permanent damage of the nerves and joints and is often accompanied by numbness or tingling of the sufferer's hands. It is known that the numbness and tingling comes from compression of the median and ulnar nerves when the carpal ligaments repetitively move through the carpal tunnel structure in the wrist while the wrist is inappropriately positioned. The precise pathology of carpal tunnel syndrome is not fully understood. However, the condition has been studied and there is a significant amount of empirical data as to practices for one doing numerous repetitive hand and wrist movements that can reduce the severity of its symptoms. Furthermore, there are other painful conditions that result from the stress imposed by repetitive hand and wrist motions, the symptoms of which can be ameliorated by proper practices while typing. It should further be understood that the symptoms of hand and wrist repetitive stress syndromes are not limited to typists but also occurs in individuals who do a large number of repetitive motions of the fingers with the wrists in various positions, such as woodwind and keyboard players. These conditions are debilitating, can prevent the typist from working, and sometimes needs surgery to correct or alleviate the condition.

It is well known that the position and stress on the user's shoulders and forearms while performing repetitive motions of the fingers are important in controlling the severity of the symptoms of a victim of carpal tunnel syndrome. In particular, individuals who do an extensive amount of typing while using their shoulders and forearms to hold their hands in an elevated position tend to experience more severe symptoms than others. Furthermore, the ubiquitous presence of the QWERTY keyboard is believed to increase the typist's susceptibility to carpal tunnel syndrome for a given amount of typing. The QWERTY keyboard was intentionally designed to require numerous repetitive movements for typing English language documents. For example, the most commonly occurring letter in the English language (e) is not on the home row on a QWERTY keyboard and each typing of the "e" requires movement of the middle digit of the left hand of the typist. The keyboard was designed intentionally to slow down the typist when typewriters had mechanical linkages to type bars which carried the impacting type element. The keyboard was designed to prevent the typist from typing with a sufficient rapidity to have multiple type bars close to the type guide and platen so as to keep the type bars from jamming.

It is believed that the practice of some typists of using their shoulders to maintain their hands in an elevated position contributes to the onset of or exacerbates the severity of carpal tunnel syndrome. In view of this, the use of padded rails and the like as rests for the wrists of typists has become popular in recent years. However, it is known that merely resting the wrist while typing does not necessarily reduce the symptoms of carpal tunnel syndrome and similar hand and wrist repetitive stress ailments.

The inventor of the present invention has discovered, by consultation with medical personnel familiar with hand and wrist repetitive stress ailments, that the best position for the hands of a typist is to have the thumb and extended fingers essentially parallel to the plane of the keys on a keyboard at which one is typing. Additionally, the hands or wrists should be supported without requiring use of the forearms and shoulders to hold the typists' hands in position. The inventor of the present invention believes that wrists rests of the type heretofore known have provided for support of the wrists or heel of the hand in a way that allows the typist not to hold his or her hands in an elevated position while typing, but that same have not adequately or fully addressed an apparatus designed to hold the typist's hands in the appropriate position in which the extended fingers stretch out parallel to a typical computer keyboard.

SUMMARY OF THE PRESENT INVENTION

The principal purpose of the present invention is to fully and adequately address the need for a wrist rest for use with a typical computer keyboard that holds the hands of the typist in the appropriate position over the keys. Generally stated, the present invention comprises a support rail of novel cross sectional geometry. The support rail includes a substantially planer lower surface that rests either on an existing work surface, or preferably on a keyboard support base for supporting the keyboard in use. It also includes an upper support surface that has a curvilinear shape in cross sections perpendicular to a longitudinal axis of the rail. The cross sectional geometry includes a pair of curvilinear nodes with a palm depression lying therebetween, which palm depression is specifically designed to hold the hypothenar of the typists' hands. The preferred geometry is further characterized by a plane that is tangential to both the forward and rearward nodes forming an angle with the plane of the bottom surface that is substantially equal to the angle that the plane of the keys forms with the work surface upon which the keyboard rests. For typical typing keyboards used with IBM personal computers and similar devices, the angle of intersection between these two planes is in the range of 10 to 20 degrees with the preferred value being 15 degrees. Thus, the plane that is tangential to the forward and rearward nodes that bound the palm depression is extended to be substantially co-planer with the plane of the surface of the keys of the keyboard in use.

The use of this structure supports the hypothenar in the palm depression and the user's wrist on the rear curvilinear node in a manner that the inventor believes to be optimum. Furthermore, the above noted constraints on the angle of the plane that is tangent to both nodes causes the fingers to be held (when extended) straight over the array of keys on the keyboard in use, which is the preferred position for minimizing the severity of the symptoms of hand and wrist repetitive motion stress conditions.

Thus, it is an object of the present invention to provide an improved wrist rest apparatus for use with a computer keyboard that allows the user to minimize his or her exposure to carpal tunnel syndrome from extensive sessions of typing.

It is a further object of the present invention to provide an improved wrist rest for which the plane of two raised forward and rearward nodes of a support rail is effectively an extension of the plane of the keyboard in use.

It is a further object of the present invention to provide such a keyboard with a properly formed palm depression for supporting the hypothenars of the typist's hands while using the apparatus.

It is still a further object of the present invention to provide a simple and inexpensive apparatus that typists will be willing to use, and will not meet use or price resistance from management of various business concerns.

That the present invention meets these and other objects will be appreciated from the detailed description of the preferred embodiment below.

DETAILED DESCRIPTION

Figure 1:
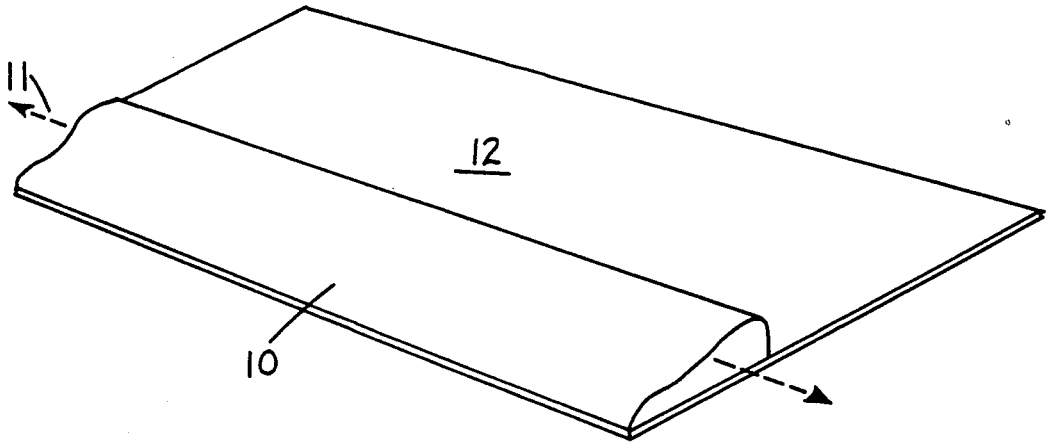
FIG. 1 is a pictorial view of the top of the preferred embodiment of the present invention.

Turning next to the drawing figures in which like numerals reference like parts, the preferred embodiment of the present invention will now be described.

Figure 2:
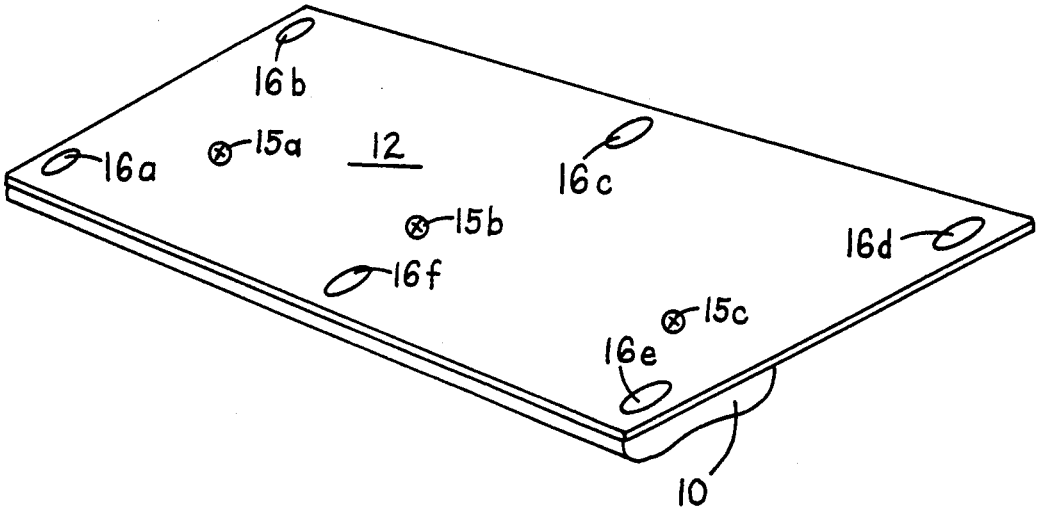
FIG. 2 is a pictorial view of the bottom of the preferred embodiment of the present invention.

FIGS. 1 and 2 show respective top and bottom pictorial views of the preferred embodiment of the present invention. The preferred embodiment includes an elongated support rail generally indicated at 10. The support rail has a characteristic longitudinal axis of elongation shown as 11 in FIG. 1. This is simply an axis that defines the lengthwise direction of support rail 10. A rectilinear keyboard support base 12 is secured to the support rail by three wood screws 15*a*–15*c* as shown in FIG. 2. While the current preferred embodiment constructed at the time of the writing of this specification uses screws to hold support rail 10 to keyboard support base 12, it is the inventor's belief that the best mode of securing the rail to the base and practical manufacturable embodiments of the present invention is to use a strip of tacky cellular foam tape interposed between support rail 10 and keyboard support base 12. The preferred embodiment includes a plurality of gummed foam rubber pads 16*a*–16*f* distributed about the periphery of the rectilinear keyboard support base. These are to provide frictional contact between the bottom of the keyboard support base and the surface that supports same in use.

Figure 3:
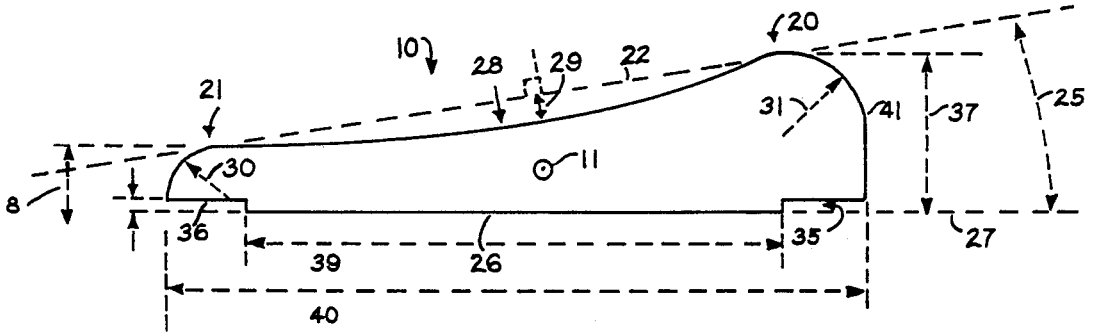
FIG. 3 is a right side elevational view of the preferred embodiment of the support rail used in the preferred embodiment.

Turning next to FIG. 3 a right side elevation of the preferred embodiment of support rail 10 is shown. While it is shown end on, it should be understood that the shape of the support rail visible in FIG. 3 is also the shape of the rail in cross sections taken in planes that are perpendicular to the axis of elongation 11.

As may be seen in FIG. 3, the support surface in such cross sections has a curvilinear shape that includes a forward node 20 and a rearward node 21. A plane indicated by dashed line 22 that is tangential to both nodes 20 and 21 forms a predetermined angle, indicated at 25, with the plane of bottom surface 26 of the support rail 10. The plane of bottom surface 26 is indicated by dashed line 27 in FIG. 3. Thus, plane 22 intersects plane 27 at the predetermined angle indicated by arcuate line 25 in FIG. 3. In the preferred embodiment of the present invention this predetermined angle is equal to 15 degrees as this is the slope of the key plane of a typical keyboard used, for example, with a personal computer manufactured by IBM Corporation, one of the more popular computing devices in use throughout the world. Also, conventional keyboards sold with similar computers, such as the class of devices known as IBM PC compatibles, likewise have a key plane that is sloped at 15 degrees to the horizontal when the keyboard rests on a horizontal work surface.

Between nodes 20 and 21 is a palm depression indicated at 28 having a lowest point, with respect to plane 22, that is referenced by dimension line 29 in the drawing figure. Dimension line 29 represents the maximum distance between plane 22 and the surface of the palm depression along any line that is perpendicular to plane 22. In the preferred embodiment the length of dimension line 29 is $\frac{1}{8}$ inch, and it is preferred to have this distance be in the range of 1/16 inch to 3/16 inch.

Nodes 21 and 22 in the preferred embodiment are formed about curvilinear portions of the cross sectional shape defined by respective radii of curvature indicated as 30 and 31 in FIG. 3. In the preferred embodiment the radius of curvature 30 at rearward node 21 is $\frac{1}{4}$, inch and is preferred to have this in the range of $\frac{1}{8}$ inch to $\frac{3}{8}$ inch. Radius of curvature 31 of forward node 20 is $\frac{3}{8}$ inch in the preferred embodiment and it is preferred to have the cross section shaped so that this radius of curvature is in the range of $\frac{1}{8}$ inch to $\frac{5}{8}$ inch.

In the preferred embodiment, respective forward and rearward notches 35 and 36 are cut from the bottom surface 26 to a depth of 1/32 inch and a length of $\frac{3}{8}$ inch. These notches are used to secure a soft covering (not shown in FIG. 3) over support rail 10. While such a covering is not essential in the construction of an embodiment of the present invention, it is preferred as it is believed to be pleasing to the tactile sense of the typist and will also absorb some perspiration. It is preferred to use a woven man-made fiber, although any form of natural fiber, leather, plastic veneer, or any other desired material may be used to cover support rail 10.

In order to fully disclose what the inventor believes to be the best mode of practicing his invention at the time of preparation of this specification, it is noted that various other dimensions of the preferred embodiment are indicated by dimension lines 37–40 shown in FIG. 3. In the preferred embodiment the height of forward node 20 above plane 27 of bottom surface 26 is ¾ inch. The corresponding height indicated by dimension line 38 for the rearward node 21 is ¼ inch. Dimension line 39 is 2½ inches long and dimension line 40 is 3¼ inches long. It should be understood that these details of dimensions are not meant to limit the scope of the present invention but only to fully describe the preferred embodiment. In the use of the support rail shown in FIG. 3, the hypothenars (or the thenars) of the hands of the user are placed in palm depression 28. This typically causes the portion of the palm lying between the proximal and distal transverses to lay on top of forward node 20. When the user is sitting at an appropriate height with respect to the surface upon which the support rail rests, the fingers will naturally extend parallel to, and slightly above, plane 22 shown in FIG. 3. It is believed that this is the optimum position for typing.

In use, the keyboard that is selected is placed on top of keyboard support base 12 and its front edge is abutted with the forward wall 41 of the support rail. Therefore, it should be understood that when sizing an embodiment of the particular invention for use with a particular keyboard the dimensions, particularly the height 37 of forward node 20, should be selected so that plane 22 that is tangent to both the nodes 20 and 21 is substantially co-planer with the plane of the keys of the keyboard when the leading edge of the keyboard is abutted to forward wall 41. In this way, plane 22 effectively becomes an extension of the plane of the keyboard and the geometry that includes palm depression 28 described hereinabove provides the optimum wrist support for the typist that will assist in alleviating the symptoms of hand and wrist repetitive stress conditions.

Figure 4:
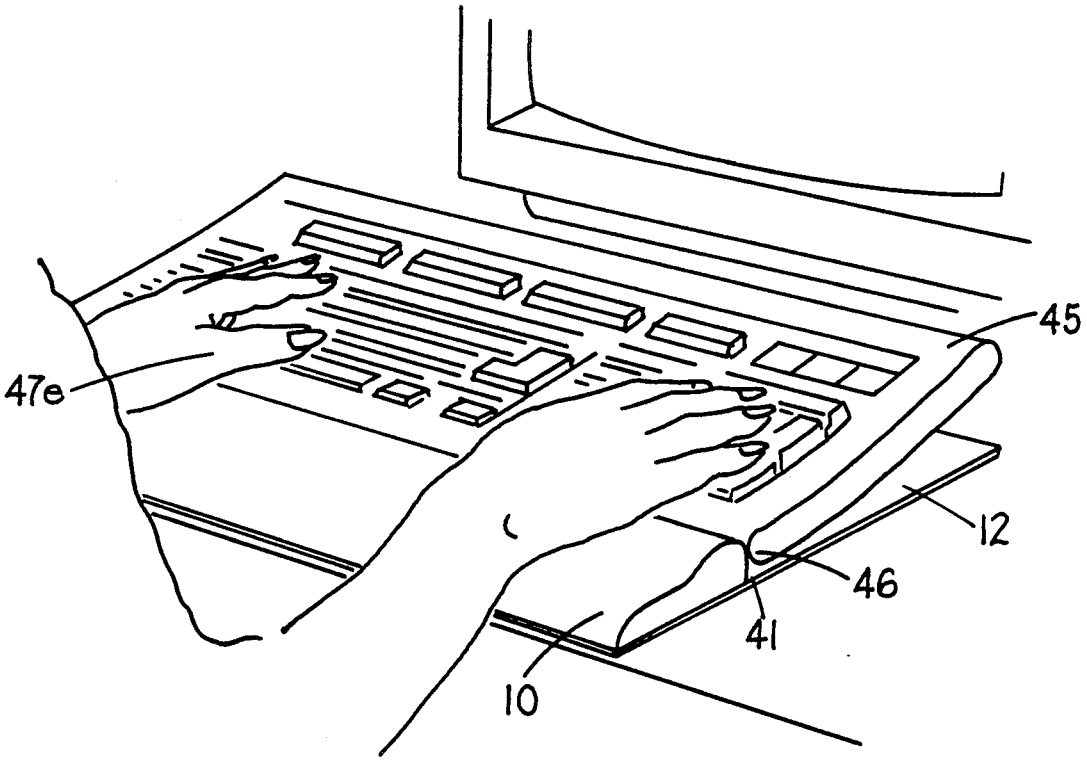
FIG. 4 is a pictorial view of the present invention in use with a typical computer keyboard.

FIG. 4 shows the preferred embodiment in use in a typical environment. A conventional IBM PC type keyboard 45 is shown resting on keyboard support base 12. The leading edge 46 of the keyboard abuts front wall 41 of support rail 10. The hands of the user are indicated at 47*l* and 47*r*. It may be seen from this drawing that the hands rest on the contours of support rail 10 as described hereinabove in connection with FIG. 3. In this configuration, the digits of the user's hands extend parallel to the key plane of keyboard 45 which is substantially identical to the plane 22 tangent to the forward and rearward nodes shown in FIG. 3.

The nature of this apparatus lends itself to construction from a wide variety of materials. In the preferred embodiment support rail 10 is machined from ¾ inch medium density fiber board stock. However, fiber board, wood, polystyrene, formed metals, injection molded plastics, and other materials may be used. It is preferred to form the computer support base 12 from polystyrene, but in addition thereto, Plexiglass, other injection molded products, wood, and other substantially rigid sheet materials may be used. Furthermore, while the preferred way of securing support rail 10 to keyboard support base 12 is the use of tacky cellular foam tape, any suitable means of attachment may be used, including glue, other adhesives, or ultrasonic welding.

From the foregoing description of the preferred embodiment of the present invention, other embodiments of the present invention will suggest themselves to those skilled in the art. Particular details of the preferred embodiment are included to fully disclose the best mode of the invention contemplated by the inventor and should not be taken as limiting of the scope of the present invention. Therefore, the scope of same is to be limited only by the claims below and equivalents thereof.

I claim:

1. An improved wrist resting apparatus comprising in combination:

a support rail that is elongated along an axis of elongation comprising a substantially planar bottom surface defining a first plane that is parallel to said axis of elongation; and a support surface lying above said first plane, said support surface being characterized by a curvilinear shape, in cross sections perpendicular to said axis of elongation, having forward and rearward nodes with a palm depression lying therebetween so as to define a second plane that is tangential to both said forward and rearward nodes and intersects said first plane at an intersection angle in the range of ten degrees to twenty degrees.

2. An improved wrist resting apparatus as recited in claim 1 wherein said intersection angle is substantially equal to fifteen degrees.

3. An improved wrist resting apparatus as recited in claim 1 wherein said forward and rearward nodes and said palm depression are arranged so that the maximum distance between said second plane and said palm depression, along any line perpendicular to said second plane, is in the range of one-sixteenth inch to three-sixteenths inch.

4. An improved wrist resting apparatus as recited in claim 1 wherein said forward and rearward nodes and said palm depression are arranged so that the maximum distance between said second plane and said palm depression, along any line perpendicular to said second plane, is substantially equal to one-eighth inch.

5. An improved wrist resting apparatus as recited in claim 1 wherein said rearward node has a characteristic radius of curvature in the range of one-eighth inch to three-eighths inch.

6. An improved wrist resting apparatus as recited in claim 1 wherein said rearward node has a characteristic radius of curvature substantially equal to one quarter inch.

7. An improved wrist resting apparatus as recited in claim 1 wherein said forward node has a characteristic radius of curvature in the range of one-eighth inch to five-eights inch.

8. An improved wrist resting apparatus as recited in claim 1 wherein said forward node has a characteristic radius of curvature substantially equal to three-eights inch.

9. An improved wrist resting apparatus comprising combination:

a support rail that is elongated along an axis of elongation comprising a substantially planar bottom surface defining a first plane that is parallel to said axis of elongation;

a support surface lying above said first plane, said support surface being characterized by a curvilinear shape, in cross sections perpendicular to said axis of elongation, having forward and rearward nodes with a palm depression lying therebetween so as to define a second plane that is tangential to both said forward and rearward nodes and intersects said first plane at an intersection angle substantially equal to fifteen degrees; and a substantially rectilinear keyboard support base secured to said substantially planar bottom surface of said support rail.

10. An improved wrist resting apparatus as recited in claim 9 further comprising means for covering said support surface.

11. An improved wrist resting apparatus as recited in claim 9 wherein said forward and rearward nodes and said palm depression are arranged so that the maximum distance between said second plane and said palm depression, along any line perpendicular to said second plane, is in the range of one-sixteenth inch to three-sixteenths inch.

12. An improved wrist resting apparatus as recited in claim 9 wherein said forward and rearward nodes and said palm depression are arranged so that the maximum distance between said second plane and said palm depression, along any line perpendicular to said second plane, is substantially equal to one-eighth inch.

13. An improved wrist resting apparatus as recited in claim 9 wherein said rearward node has a characteristic radius of curvature in the range of one-eighth inch to three-eighths inch.

14. An improved wrist resting apparatus as recited in claim 9 wherein said rearward node has a characteristic radius of curvature substantially equal to one quarter inch.

15. An improved wrist resting apparatus as recited in claim 9 wherein said forward node has a characteristic radius of curvature in the range of one-eighth inch to five-eights inch.

16. An improved wrist resting apparatus as recited in claim 9 wherein said forward node has a characteristic radius of curvature substantially equal to three-eights inch.

17. An improved wrist resting apparatus as recited in claim 9 wherein said forward and rearward nodes and said palm depression are arranged so that the maximum distance between said second plane and said palm depression, along any line perpendicular to said second plane, is in the range of one-sixteenth inch to three-sixteenths inch;

said rearward node has a characteristic radius of curvature in the range of one-eighth inch to three-eighths inch; and said forward node has a characteristic radius of curvature in the range of one-eighth inch to five-eights inch.

18. An improved wrist resting apparatus as recited in claim 17 further comprising means for covering said support surface.

19. An improved wrist resting apparatus as recited in claim 1 wherein said forward and rearward nodes and said palm depression are arranged so that the maximum distance between said second plane and said palm depression, along any line perpendicular to said second plane, is in the range of one-sixteenth inch to three-sixteenths inch;

said rearward node has a characteristic radius of curvature in the range of one-eighth inch to three-eighths inch; and said forward node has a characteristic radius of curvature in the range of one-eighth inch to five-eights inch.

20. An improved wrist resting apparatus as recited in claim 1 wherein said support rail is constructed of medium density fiber board.

21. An improved wrist resting apparatus as recited in claim 1 wherein said support rail is constructed of wood.

22. An improved wrist resting apparatus as recited in claim 1 wherein said support rail is constructed of injection moulded plastic.

23. An improved wrist resting apparatus for use with a keyboard having at least one array of keys defining a key plane that intersects a horizontal plane at a predetermined non-zero key plane angle when said keyboard rests on a horizontal surface, comprising in combination:

a support rail that is elongated along an axis of elongation comprising a substantially planar bottom surface defining a first plane that is parallel to said axis of elongation; and a support surface lying above said first plane, said support surface being characterized by a curvilinear shape, in cross sections perpendicular to said axis of elongation, having forward and rearward nodes with a palm depression lying therebetween so as to define a second plane that is tangential to both said forward and rearward nodes and intersects said first plane at an intersection angle that is substantially equal to said predetermined key plane angle.

24. An improved wrist resting apparatus for use with a keyboard having a leading edge and at least one array of keys defining a key plane that intersects a horizontal plane at a predetermined non-zero key plane angle when said keyboard rests on a horizontal surface, comprising in combination:

a support rail that is elongated along an axis of elongation comprising a substantially planar bottom surface defining a first plane that is parallel to said axis of elongation; and a support surface lying above said first plane, said support surface being characterized by a curvilinear shape, in cross sections perpendicular to said axis of elongation, having forward and rearward nodes with a palm depression lying therebetween and a forward wall adjacent to said forward node, said forward and rearward nodes defining a second plane that is tangential to both said forward and rearward nodes and intersects said first plane at an intersection angle that is substantially equal to said predetermined key plane angle and said second plane is substantially co-planar with said key plane when said leading edge of said keyboard is in abutment with said forward wall of said support surface.

* * * * *